US007131303B1

(12) United States Patent
Champaigne

(10) Patent No.: US 7,131,303 B1
(45) Date of Patent: Nov. 7, 2006

(54) SHOT PEENING OF ORTHOPAEDIC IMPLANTS FOR TISSUE ADHESION

(75) Inventor: Jack Champaigne, Mishawaka, IN (US)

(73) Assignee: Electronics, Inc., Mishawaka, IN (US)

( * ) Notice: Subject to any disclaimer, the term of this patent is extended or adjusted under 35 U.S.C. 154(b) by 0 days.

(21) Appl. No.: 11/280,692

(22) Filed: Nov. 16, 2005

Related U.S. Application Data

(60) Provisional application No. 60/628,691, filed on Nov. 17, 2004.

(51) Int. Cl.

| | |
|---|---|
| ***B21J 51/28*** | (2006.01) |
| ***B24C 1/00*** | (2006.01) |
| *A16F 5/04* | (2006.01) |
| *B21S 51/28* | (2006.01) |

(52) U.S. Cl. ..... 72/53; 29/90.7; 451/38; 451/39

(58) Field of Classification Search ..... 72/53; 29/90.7; 451/38, 39

See application file for complete search history.

(56) References Cited

U.S. PATENT DOCUMENTS

| | | | | |
|---|---|---|---|---|
| 4,428,213 A | | 1/1984 | Neal et al. | |
| 5,057,108 A | * | 10/1991 | Shetty et al. | 72/53 |
| 5,251,468 A | * | 10/1993 | Lin et al. | 72/53 |
| 5,592,840 A | | 1/1997 | Miyasaka | |
| 5,673,473 A | * | 10/1997 | Johnson et al. | 29/90.7 |
| 5,704,239 A | * | 1/1998 | Beals et al. | 72/53 |
| 6,012,316 A | * | 1/2000 | Lange et al. | 72/53 |
| 6,502,442 B1 | * | 1/2003 | Arola et al. | 72/53 |
| 6,911,100 B1 | * | 6/2005 | Gibbs et al. | 29/407.05 |

OTHER PUBLICATIONS

Biomaterials and Medical Implant Science: Present and Future Perspectives; an NIH Workshop; Oct. 16 & 17, 1995; USA.

Textured Titanium Medical Implants May Be Better Than Smooth Ones; Posted by: News-Medical in Medical Device News; Published Jun. 14, 2004.

* cited by examiner

*Primary Examiner*—David Jones
(74) *Attorney, Agent, or Firm*—Botkin & Hall, LLP

(57) ABSTRACT

The portion of an orthopaedic implant to which soft tissue adherence is desired is treated by shot peening using microbead having a diameter in the range of about 10 microns–300 microns. This treatment causes indentations on the surface of the implant of about 10 microns to about 50 microns to provide a fine, shallow texturing of the implant that permits the soft tissue to adhere, but is not rough enough that it will interlock with hard tissue.

11 Claims, 4 Drawing Sheets

SHOT PEENING OF ORTHOPAEDIC IMPLANTS FOR TISSUE ADHESION

This invention claims domestic priority based upon U.S. Provisional Patent Application Ser. No. 60/628,691, filed Nov. 17, 2004.

TECHNICAL FIELD

This invention relates to orthopaedic implants that have been treated to improve tissue adhesion.

BACKGROUND OF THE INVENTION

Proper adhesion of soft tissue to orthopaedic implants is important but has proven difficult to achieve. For example if the implant surface to which tissue adherence is desired is smooth, tissue cannot easily adhere to the implant and the body forms a tissue capsule around the implant, sealing it off from the rest of the body. This impairs the implant's function. Since the implant constantly moves relative to the tissue, resulting friction causes inflammation and creates a steadily growing capsule of dead tissue. Accordingly, implant surfaces to which tissue adherence is desired have been textured, but too great a degree of surface roughness can permit connective tissue and bone to grow into the fissures. The implant essentially grows into the body and removal of the implant becomes almost impossible, and if possible results in major bone loss.

Shot peening has been used to increase strength and wear resistance of orthopaedic implants, as disclosed in U.S. Pat. No. 5,704,239. Shot peening to increase strength uses shot media of a size and applied at an intensity sufficient to compress the layer just under the surface to thereby increase strength. Shot having a diameter of 0.0011"–0.0023" would typically be used (identified by industry standard S110–S130 shot).

SUMMARY OF THE INVENTION

According to the invention, the portion of an orthopaedic implant to which tissue adherence is desired is treated by shot peening using microbead, that is, shot that is much smaller than shot used to effect strengthening of the implant. Microbead has a diameter in the range of about 10 microns–300 microns and when used at normal intensity causes indentations on the surface of the implant of about 10 microns to about 50 microns. This does not cause compression of the layer just below the surface, but instead provides fine, shallow texturing of the implant that permits the fibroblasts of the connective tissue a surface to which to adhere. However, the implant is not rough enough that it will interlock with hard tissue, such as bone tissue. Furthermore, shot peening is a well known and relatively simple and inexpensive process, which is relatively easily controlled to effect the desired tissue adherence. Other methods of surface treatment are more difficult and expensive, and are less easily controlled to effect the degree of surface roughness that permits soft tissue to adhere, but that is not rough enough that hard tissue will also adhere.

DESCRIPTION OF THE PREFERRED EMBODIMENT

Figure 1:
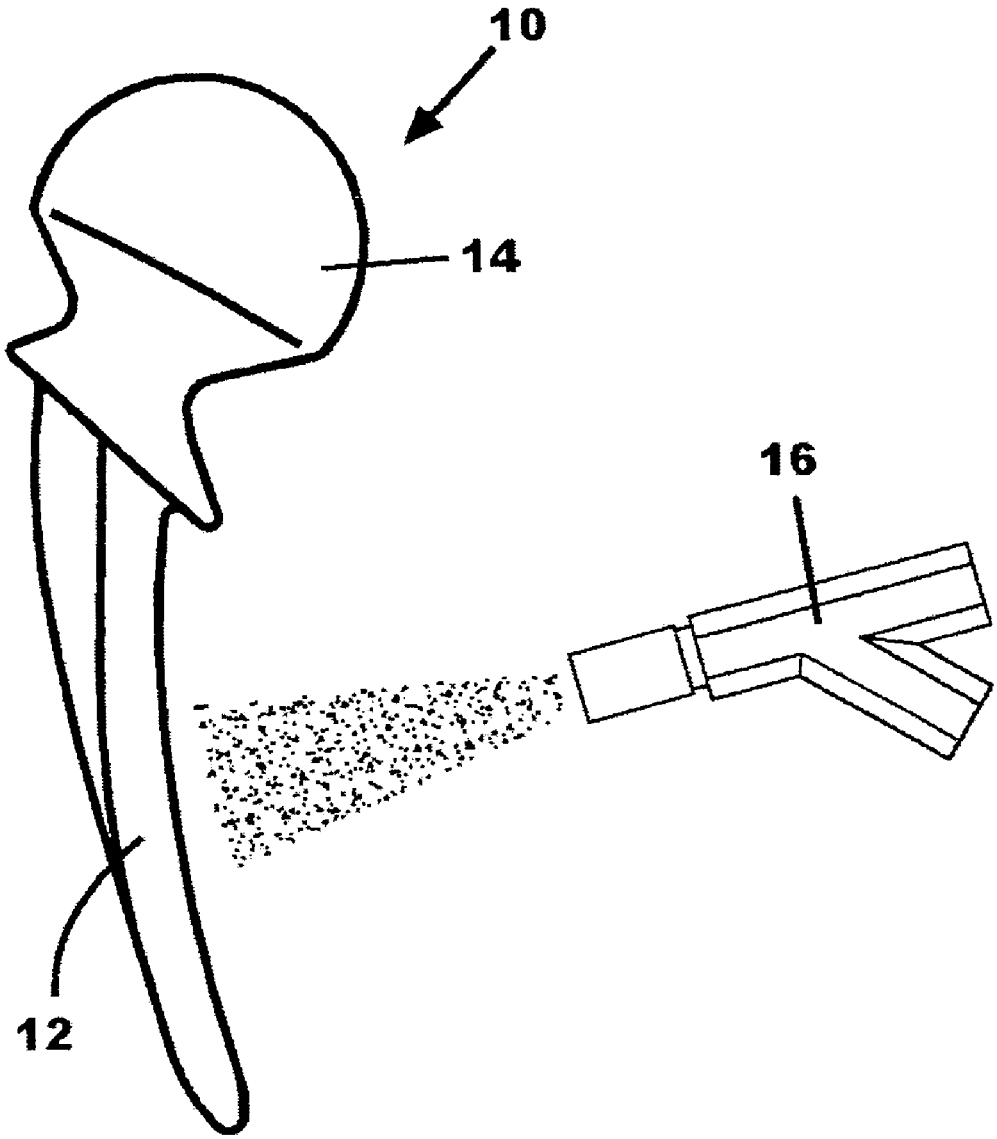
FIG. 1 is a view in perspective of an orthopaedic implant shown schematically with a typical device for shot peening the implant.

Referring now to FIG. 1, a typical orthopaedic implant is illustrated at 10. The implant 10 as illustrated is a femoral prosthesis used in hip replacement surgery. The implant 10 includes a stem 12, which is implanted within the patient's femur, and a ball 14 mounted upon the stem 12 but which projects from the patients femur and engages a compatible prosthesis (not shown) mounted on the patient's pelvis. Since only the stem 12 is implanted within the femur, and thus it is desired that soft tissue adhere only to the stem 12, only the stem 12 is to be treated as described herein. A conventional shot peening gun used to treat the implant 10 is illustrated at 16 and is connected to a source of compressed air (not shown) and to a source of conventional shot or of microbead as will be discussed hereinafter. The shot or microbead is mixed with the air stream from the compressed air source by conventional apparatus assuring that the shot or microbead is mixed with the air stream so that it can be applied to the implant 10 at the desired intensity. The gun 16 is moved over the implant 10 until the desired coverage is achieved. Since it is desired that tissue adhere only to the stem 12, only the stem 12 is to be treated with the microbead.

Figure 2:
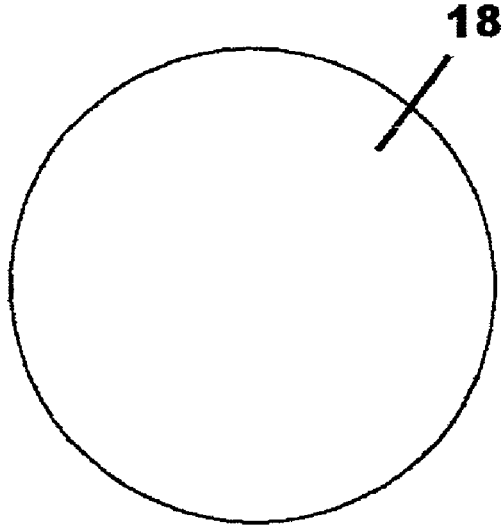
FIGS. 2 and 3 are views of, respectively, normal shot used for strengthing implants and microbead used to texture implants, illustrating the relative sizes of the shot and the microbead.

As discussed above, the conventional shot 18, which is shown greatly enlarged in FIG. 2, typically has a diameter of about 0.0011" to about 0.0023" (identified in the trade as S-110 to S-230 shot). The shot 18 may be steel, ceramic, or any other shot known in the industry. When applied to the outer surface 20 of the stem 12 by the gun 16, the size of the shot 18 is sufficient to cause depressions 22 in the surface 20 and dimples 24 between the depressions, thus causing compression of the layer 26 below the surface 20, to thereby effect hardening of the device as is well known to those skilled in the art. As is also well known, the depth and concentration of the depressions is a function of the size of the shot 18 and the intensity of the shot peening, which may be regulated by known methods. Implants have been hardened by shot peening in the prior art.

Figure 3:
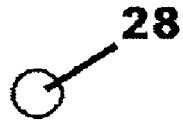
Figure 4:
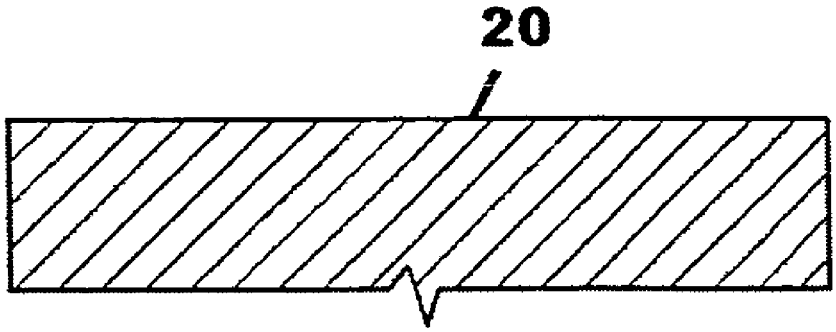
FIG. 4 is an enlarged view of the untreated surface and layer just below the surface of a portion of the implant illustrated in FIG. 1.
Figure 5:
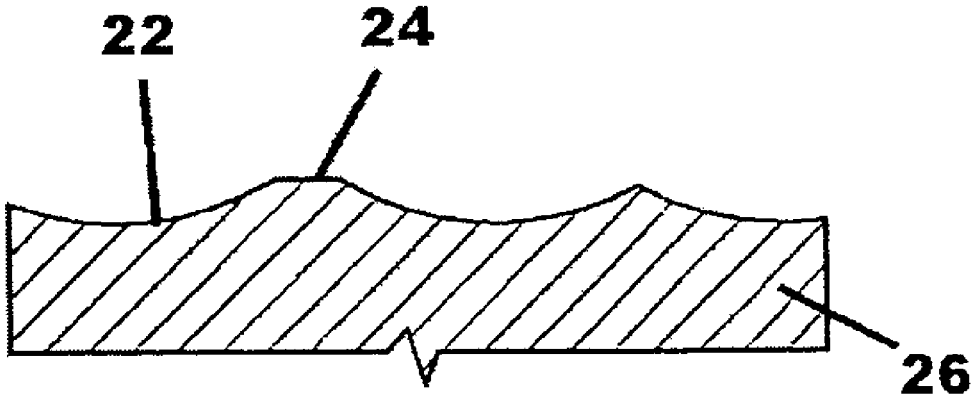
FIG. 5 is a view similar to FIG. 4, but illustrating the surface after being shot peened by shot illustrated in FIG. 2.
Figure 6:
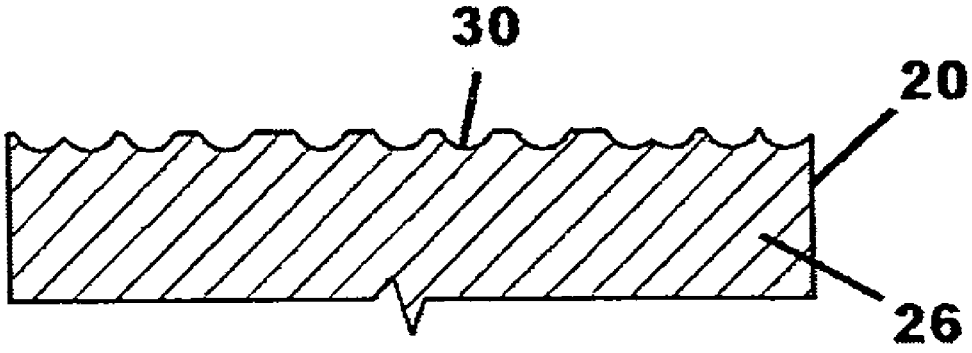
FIG. 6 is a view similar to FIG. 4, but illustrating the surface after being shot peened by microbead illustrated in FIG. 3.

The present invention uses shot peening using microbead having a diameter between about 50 microns and about 300 microns to effect texturing of the surface 20 of the implant stem 12 to facilitate adhesion thereto by soft tissue, The microbead is illustrated greatly enlarged at 28 in FIG. 3, but the relative sizes of the micrbead 28 and the conventional shot 18 is about as illustrated in FIGS. 2 and 3. The microbead 28 is applied to the stem 12 of the implant by the gun 16 controlling a compressed air stream in which the microbead 28 is entrained in the same way that the conventional shot 18 is applied to the stem 12. However, the small size of the microbead 28 does not appreciably compress the layer 26 below the surface 20, and thus does not appreciably affect hardness. As seen in FIG. 6, shot peening using the microbead 28 results in many small indentations 30 in the surface 20, each having a depth in the range of about 10 microns to about 50 microns thus creating a textured surface compatible with soft tissue adhesion but which indentations are not deep enough to encourage hard tissue growth within the indentations.

Figure 7:
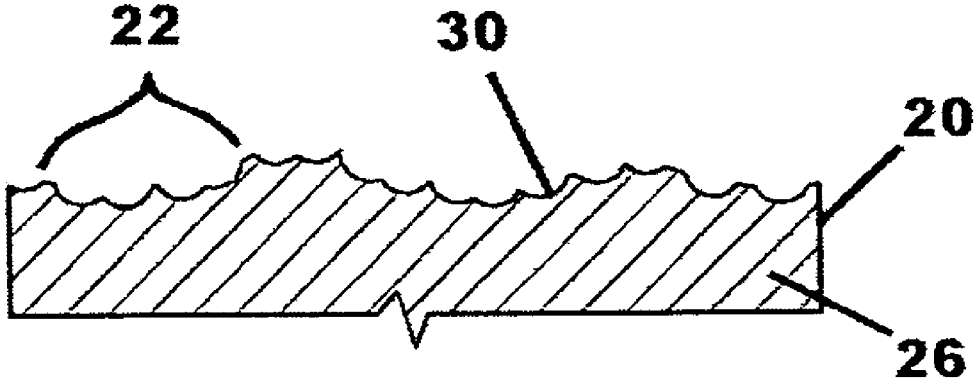
FIG. 7 is a view similar to FIGS. 4–6, but illustrating the surface after being shot peened by shot illustrated in FIG. 2 and thereafter being shot peened by microbead illustrated in FIG. 3.

Referring to FIG. 7, implants may first be hardened by application of convention shot 18, followed by texturing using microbead 28. Accordingly, the stem is first shot peened by the conventional shot 18 to create large depressions 22, and is thereafter shot peened using the microbead 28, to impose the smaller indentations 30 on the surface. Accordingly, the implant 10 is hardened by the conventional shot peening and then textured using microbead.

It is recognized, of course, that most shot is not perfectly spherical. Accordingly, as used herein, the term "diameter" refers to the largest dimension of shot that is not a true sphere.

The invention claimed is:

1. Method of treating a surface of a medical implant by shot peening said surface using larger shot sufficient to cause compression of the layer immediately below said surface to increase hardness and thereafter shot peening said surface with smaller shot sufficiently small to effect texturing of said surface without substantial compression of the layer immediately below said surface to improve tissue adhesion.

2. Method of treating a surface of a medical implant as claimed in claim 1, wherein said step of shot peening with smaller shot is effected using shot having a diameter of between about 10 microns and about 300 microns.

3. Method of treating a surface of a medical implant as claimed in claim 2, wherein said step of shot peening with larger shot is effected using shot having a diameter of between about 0.0011 inches to about 0.0023 inches.

4. Method of treating a surface of a medical implant as claimed in claim 1, wherein said step of shot peening with smaller shot is effected at an intensity sufficient to form depressions on said surface having a depth of between about 10 microns and about 50 microns.

5. Method of treating a surface of a medical implant as claimed in claim 1, wherein said step of shot peening with larger shot is effected at an intensity sufficient to form relatively larger depressions in said surface and said step of shot peening with said smaller shot is performed after shot peening with said larger shot and at an intensity to form relatively smaller depressions in said surface, including within said larger depressions.

6. Method of treating a surface of a medical implant as claimed in claim 5, wherein said step of shot peening with smaller shot is effected using shot having a diameter of between about 10 microns and about 300 microns.

7. Method of treating a surface of a medical implant as claimed in claim 5, wherein said step of shot peening with smaller shot is effected using shot having a diameter of between about 10 microns and about 300 microns, and said step of shot peening with said larger shot is effected using shot having a diameter of between about 0.0011 inches to about 0.0023 inches.

8. Method of treating a surface of a medical implant to improve tissue adhesion by shot peening said surface using shot having a diameter of between about 10 microns and about 300 microns.

9. Method of treating a surface of a medical implant as claimed in claim 8, wherein said shot peening is effected at an intensity sufficient to cause depressions on said surface having a depth of between about 10 microns and about 50 microns.

10. Method of treating a surface of a medical implant to improve tissue adhesion by texturing said surface by shot peening said surface at an intensity below that causing substantial compression of the layer of said implant immediately below said surface.

11. Method of treating a surface of a medical implant as claimed in claim 10, wherein said surface is peened at an intensity to causing depressions on said surface having a depth of between about 10 microns and about 50 microns.

* * * * *